United States Patent [19]

Watson et al.

[11] 4,407,442

[45] Oct. 4, 1983

[54] BI-LEVEL DUAL CELL CARTON

[75] Inventors: William H. Watson, John E. Straw, both of St. Louis, Mo.

[73] Assignee: Container Corporation of America, Chicago, Ill.

[21] Appl. No.: 324,771

[22] Filed: Nov. 25, 1981

[51] Int. Cl.[3] ..... B65D 5/48

[52] U.S. Cl. ..... 229/28 R; 229/15; 229/27; 206/491

[58] Field of Search ..... 206/326, 427, 429, 491, 206/424; 229/15, 16 D, 16 R, 27, 28, 38, 44 R

[56] References Cited

U.S. PATENT DOCUMENTS

| | | | |
|---|---|---|---|
| 1,188,825 | 6/1916 | Potter | 229/16 R |
| 1,630,497 | 5/1927 | Morris | 229/15 |
| 2,015,278 | 9/1935 | Meyer | 229/27 |
| 2,626,739 | 1/1953 | Feigelman | 229/15 |
| 2,774,468 | 12/1956 | Rous | 206/427 |
| 2,891,710 | 6/1959 | Repking | 229/44 R |
| 3,294,233 | 12/1966 | Hollinger | 229/15 |
| 3,510,046 | 5/1970 | Reiner | 229/27 |
| 3,871,520 | 3/1975 | Hand | 206/491 |
| 3,934,720 | 1/1976 | Kratochvil, Jr. | 206/326 |
| 4,098,401 | 7/1978 | Brown et al. | 206/326 |
| 4,125,185 | 11/1978 | Bliss | 229/27 |
| 4,126,222 | 11/1978 | Aust | 206/326 |
| 4,146,128 | 3/1979 | Hogg et al. | 206/318 |
| 4,185,741 | 1/1980 | Schiff et al. | 206/326 |
| 4,294,397 | 10/1981 | Kohler | 229/38 |

*Primary Examiner*—William Price
*Assistant Examiner*—David Fidei
*Attorney, Agent, or Firm*—Richard W. Carpenter; Davis Chin

[57] ABSTRACT

A tubular carton structure having a pair of adjacent cells of different heights and side wall extension disposed over both of the cells.

4 Claims, 5 Drawing Figures

BI-LEVEL DUAL CELL CARTON

BACKGROUND OF THE INVENTION

1. Field of the Invention

This invention relates to folding cartons, and more particularly to a carton having a pair of adjacent cells of different heights.

2. Description of the Prior Art

A prior art search in the United States Patent and Trademark Office directed to the subject matter of this application disclosed the following U.S. Pat. Nos.: 584,072; 2,015,278; 2,344,182; 2,442,699; 3,563,449; 3,901,386; 3,913,739; 4,170,298.

None of the prior art patents disclosed a bi-level dual cell carton wherein one of the end walls has an extension with sections which serves as a cover for each of the separate cells of the carton in the manner of the present invention.

SUMMARY OF THE INVENTION

An object of the invention is to provide a new and improved folding carton, formed of unitary blank of foldable paperboard, which includes a pair of adjacent cells of different heights.

A more specific object of the invention is to provide a novel closure arrangement for a carton of the type described wherein one of the end walls has an extension with sections which serve as closures for both of the cells of the carton which cells are of different heights.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
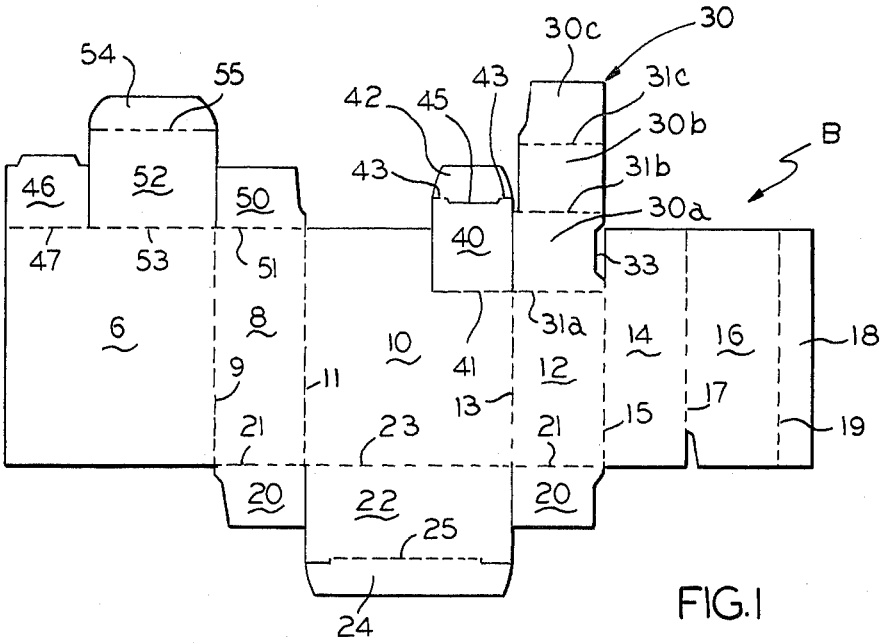
FIG. 1 is a plan view of a blank of foldable sheet material from which the carton structure illustrated in the other views may be formed.
Figure 2:
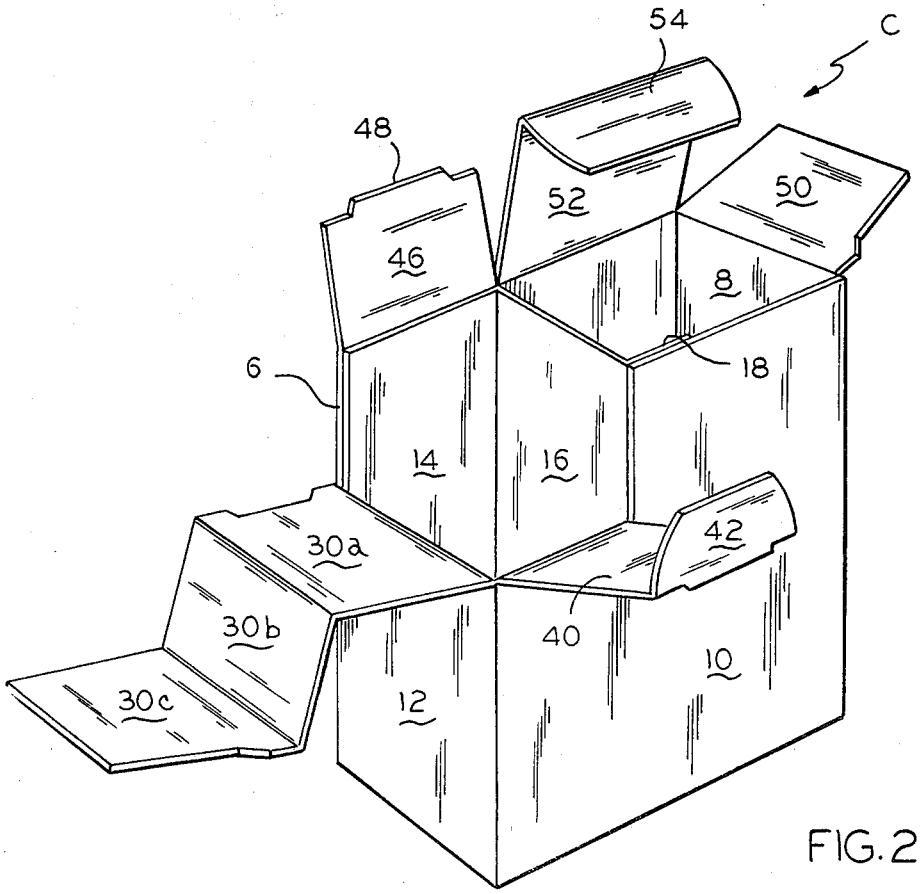
FIGS. 2, 3 and 4 are perspective views illustrating various stages in forming and erecting a folding carton from the blank illustrated in FIG. 1.

Referring now to the drawings for a better understanding of the invention, and particularly to FIGS. 1 and 2, it will be seen that the novel folding carton embodying features of the invention is a tubular structure including a pair of internal cells of different heights.

The carton indicated generally at C may be formed from a unitary blank B of foldable sheet material, such as paperboard illustrated in FIG. 1.

Still referring to FIGS. 1 and 2, it will be seen that the body of the carton C includes a rear side wall panel 6, a first end wall panel 8, a front side wall panel 10, a second side wall panel 12, a connecting panel 14, a partition panel 16, and a glue flap 18 which are foldably joined to each other on fold lines 9, 11, 13, 15, 17, and 19, respectively. As best seen in FIG. 2 connecting panel 14 is secured to the inner face of rear side wall panel 6, and partition panel 16 is disposed to extend between front and rear side wall panels 10 and 6, to divide the interior of the carton into separate cells, with glue flap 18 being secured to the inner surface of front side wall panel 10.

Thus it will be appreciated that a tubular structure is provided which is open at the ends and contains a pair of internal cells. Closure of the lower end of the structure may be accomplished in the conventional manner by a closure flap arrangement which includes a pair of inner closure flaps 20, foldably joined along fold lines 21 to the lower edges of first and second end wall panels 8 and 12, and an outer closure flap 22, which is foldably joined on fold line 23 to the lower edge of front side wall panel 10. Foldably joined to the free edge of outer closure flap 22 along fold line 25 is a tuck tab 24.

Closure of the upper end of the carton is far from conventional, however, because the different heights of the two adjacent cells creates a unique problem from the closure standpoint.

As noted, second side wall panel 12 is of substantially lesser height than first side wall panel 8, so that when the two cells are closed, in a manner hereinafter described, one of the cells is of a greater height than the other.

Figure 3:
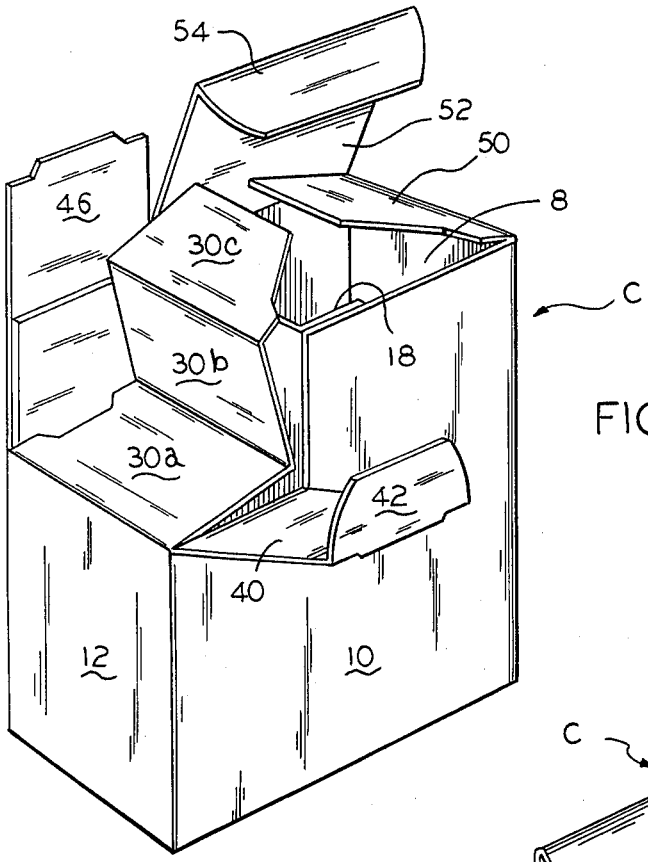
Figure 4:
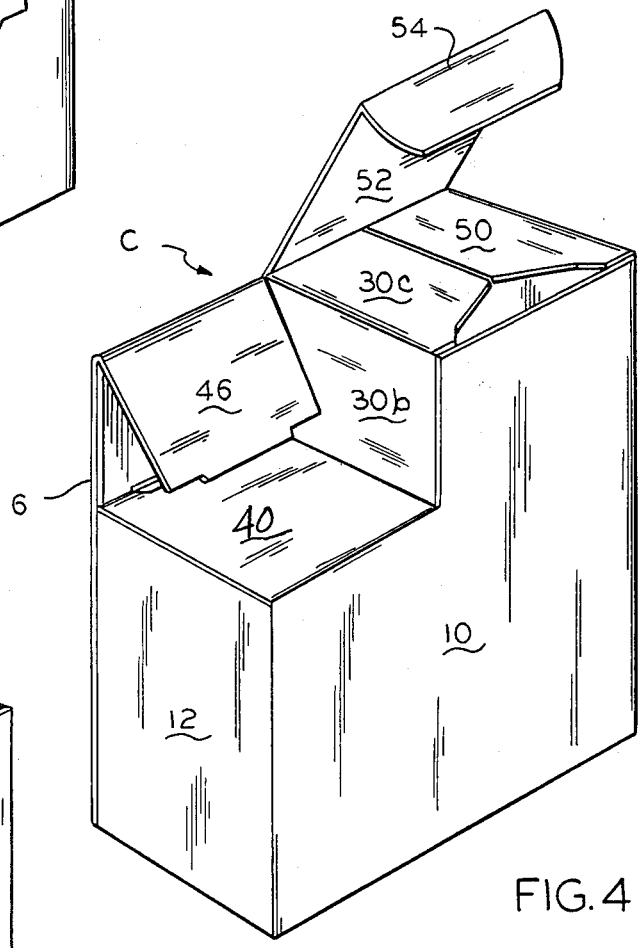

As best seen in FIGS. 2, 3, and 4 there is provided an extension, indicated generally at 30, which is foldably joined to panel 12, the shorter of the side wall panels.

Extension 30 includes a first section **30*a* which is foldably joined on fold line 31*a* to the upper edge of second side wall panel 12** and which is folded inwardly and normal thereto so as to overlie the shorter of the cells and to serve as an inner closure flap for the cell.

Extension 30 also includes a second section **30*b* which is foldably joined to the inner edge of section 30*a* and which is folded normal thereto to extend upwardly therefrom against the outer face of partition panel 16**.

Figure 5:
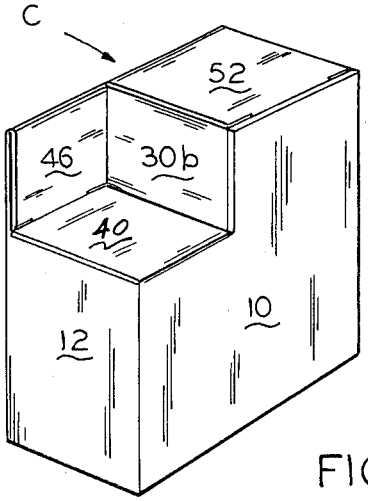
FIG. 5 is a perspective view of a completely assembled and erected folding carton embodying features of the invention.

Extension 30 also includes a third section **30*c* which is foldably joined along fold line 31*c* to the upper edge of section 30*b* and which is folded normal thereto to overlie and serve opposite flap 50 as one of a pair of inner closure flaps covering the second or taller of the cells. As best seen in FIGS. 4 and 5, after section 30*a* has been folded into position, outer closure flap 40, which is foldably joined on fold line 41 to an upper edge of front side wall panel 10, is folded to overlie section 30*a*. A tuck tab 42, joined on fold lines 43 to an edge of flap 42, may be inserted into a recess 33 formed in a side edge of section 30*a*. Then, as a special locking feature, a lock tab 46, which is foldably joined to the upper edge of rear side wall panel 6 on fold line 47, may be folded downwardly 180° so as to overlie the front side of rear side wall panel 6 and connecting panel 14, with the extended portion 48 of the lock tab being received through recess 45 and into recess 33 of section 30*a***.

Closure of the taller of the two cells is accomplished by folding the previously referred to section **30*c* over across the top of the cell and also folding the other inner closure flap 50, which is foldably joined to first end wall panel 8 on fold line 51, over at right angles to the related end wall panel. Outer closure flap 52, which is foldably joined on fold line 53 to the upper edge of rear side wall panel 6, may then be folded to overlie the inner closure flaps. Tuck flap 54, which is foldably joined to flap 52 on fold line 55, may then be inserted into position behind front side wall panel 10**.

Thus, it will be appreciated that the novel carton construction includes a dual cell carton where the cells have different heights and wherein one extension hinged to a side wall panel covers both of the cells.

What is claimed is:

1. A bi-level, dual cell carton formed of a unitary blank of foldable sheet material such as paperboard, comprising:

(a) front and rear side wall panels and first and second end wall panels foldably joined to each other to form a tubular structure open at the ends;

(b) said end wall panels being of different heights;

(c) an internal partition panel extending between said side wall panels in parallel relation with said end wall panels to divide the interior of said tubular structure into two adjacent cells of different heights;

(d) upper and lower closure flaps joined to upper and lower edges, respectively, of said side wall and end wall panels and being folded into overlapped relation to close the upper and lower ends of said tubular structure;

(e) said upper closure flaps including an extension foldably joined to shorter of said end wall panels and including:

(i) a first section joined to an upper edge of said shorter end wall panel and folded normal thereto to overlie the shorter of said cells;

(ii) a second section joined to an inner edge of said first section and folded normal thereto against a portion of said partition panel;

(iii) a third section joined to an upper edge of said second section and folded normal thereto to overlie the taller of said cells;

(f) said upper closure flaps further including a first outer closure flap foldably joined to said front side wall panel and disposed to overlie said first section of the extension and a second outer closure flap foldably joined to said rear side wall panel and disposed to overlie said third section of the extension; and (g) a lock flap foldably joined to an upper edge of said rear side wall panel and being folded downwardly 180° into engagement with said first outer closure flap.

2. A carton according to claim 1, wherein said rear wall side panel is generally rectangular and said front wall side panel is generally L-shaped.

3. A carton according to claim 1, wherein said partition panel is foldably joined:

(a) at one side edge to one edge of a connecting panel which has another edge foldably joined to one of said end wall panels;

(b) at the other side edge to a glue flap which is secured to said front side wall panel;

4. A carton according to claim 3, wherein said connecting panel is disposed to lie against an inside face of said rear side wall panel.

* * * * *